US005758707A

United States Patent [19]

Jung et al.

[11] Patent Number: 5,758,707

[45] Date of Patent: Jun. 2, 1998

[54] METHOD FOR HEATING METALLIC BODY TO SEMISOLID STATE

[75] Inventors: Paul Jung, Niederuzil; Siegfried Erhard, Oberuzwil; Max Moesli, Uzwil, all of Switzerland; Kenneth P. Young, Denver, Colo.

[73] Assignee: Buhler AG, Uzwil, Switzerland

[21] Appl. No.: 816,808

[22] Filed: Mar. 19, 1997

Related U.S. Application Data

[63] Continuation of Ser. No. 547,786, Oct. 25, 1995, abandoned.

[51] Int. Cl.[6] ..... B22D 46/00; B22D 27/04; B22D 17/04; C22F 1/04

[52] U.S. Cl. ..... 164/4.1; 164/122; 164/900; 164/113

[58] Field of Search ..... 164/4.1, 120, 122, 164/900, 71.1, 113; 148/549, 538

[56] References Cited

U.S. PATENT DOCUMENTS

| | | |
|---|---|---|
| 2,932,865 | 4/1960 | Bauer . |
| 3,663,730 | 5/1972 | Gates . |
| 3,954,455 | 5/1976 | Flemings et al. . |
| 4,434,839 | 3/1984 | Vogel . |
| 4,569,218 | 2/1986 | Baker et al. . |
| 4,687,042 | 8/1987 | Young . |
| 5,009,844 | 4/1991 | Laxmanan . |
| 5,571,346 | 11/1996 | Bergsma . |

FOREIGN PATENT DOCUMENTS

| | | |
|---|---|---|
| 0120584 A1 | 10/1984 | European Pat. Off. . |
| 0147243 | 7/1985 | European Pat. Off. . |
| 640842 | 7/1928 | France . |
| 73485 | 3/1994 | Japan . |
| 1499934 | 2/1978 | United Kingdom . |

OTHER PUBLICATIONS

"Thixocasting Copper–Base Alloys", K.P. Young, J.F. Boylan, B.E. Bond, R.G. Riek, R.L. Bye and M.C. Flemings, *Die Casting Engineer*, (Mar.–Apr. 1977), pp. 46–52.

"Improving the Quality of Aluminum Diecastings by Novel Techniques", G.B. Brook, *Materials & Design*, vol. 3 (Oct. 1982), pp. 558–565.

"Structure and Properties of Thixocast Steels" by K.P. Young et al., *Metals Technology* (Apr. 1979), pp. 130–137.

"Specific Properties of Produced Parts using the Thixocasting–Process" by J.P. Gabathuler et al., *International Conference of Aluminum Alloys: New Process Technologies*, Marina di Ravenna, Italy, (Jun. 3–4, 1993), pp. 169–180.

"Production of Automotive Components By Pressure Diecasting in the Semi–Liquid State" by R. Moschini et al., *International Conference of Aluminum Alloys: New Process Technologies*, Marina di Ravenna, Italy, (Jun. 3–4, 1993), pp. 143–156.

"Primary and Wrought Products for Semisolid Forming of Aluminium Alloys" by P. Fiorini et al., *International Conference of Aluminum Alloys: New Process Technologies*, Marina di Ravenna, Italy, (Jun. 3–4, 1993), pp. 117–128.

"Primary and Wrought Products for Semisolid Forming of Aluminium Alloys" by F. Fiorini, *La metallurgia italiana*, vol. 86,n. (Feb. 1994), pp. 91–98.

"Specific Properties of Produced Parts Using the Thixocasting Process" by J.P. Gabathuler, *La metallurgia italiana*, vol. 86,n. (Dec. 1994), pp. 609–615.

(List continued on next page.)

*Primary Examiner*—Joseph J. Hail, III
*Assistant Examiner*—I.-H. Lin
*Attorney, Agent, or Firm*—Burns, Doane, Swecker and Mathis, L.L.P.

[57] ABSTRACT

Metallic bodies are heated up to a predetermined temperature between the solidus and the liquidus to produce a semisolid state by supplying the metallic bodies with different amounts of energy over time. The metallic bodies are initially heated with a higher amount of energy, whereafter the supply of energy is lowered. Varying amounts of energy may also be employed to control the desired temperature as a function of shaping pressure or cycle time of the shaping machine.

23 Claims, 2 Drawing Sheets

OTHER PUBLICATIONS

"Development of Semi-Solid Metal Forming Feedstock and Finished Parts" by C. Pluchon et al., *Proceedings of the technical sessions presented by the TMS Light Metals Committee at the 124th TMS Annual Meeting, Las Vegas* (Feb. 12–16, 1995), pp. 1233–1242.

"Industrial Plant For Casting and Forming Semisolid Aluminium Alloy Billets" by S. Abis et al., *International Conference of Aluminium Alloys: New Process Technologies,* Marina di Ravenna, Italy, (Jun. 3–4, 1993).

"Thixoforming of Al-Alloys" by P. Kapranos et al., *International Conference of Aluminium Alloys: New Process Technologies,* Marina di Ravenna, Italy, pp. 87–95, (Jun. 3–4, 1993).

"Die Casting of Aluminium Alloy in Semi-Solid State" by K. Kitamura, *International Conference of Aluminium Alloys: New Process Technologies,* Marina di Ravenna, Italy, pp. 97–108 (Jun. 3–4, 1993).

*"Thixocasting Copper-Base Alloys",* K.P. Young, J.F. Boylan, D.C. Bond, R.G. Riek, R.L. Bye and M.C. Flemings, Massachusetts Institute of Technology, Die Casting Engineer, (Mar.–Apr. 1977), pp. 46–52.

*"Improving the Quality of Aluminum Diecastings by Novel Techniques",* G.B. Brook, Fulmer Research Institute, Materials & Design, vol. 3 (Oct. 1982), pp. 558–565.

Thixoforming of Al Alloys Using Modified Chemical Grain Refiningnent for Billet Production, Wan et al. Int. Conf. "Al Alloys: New Process Tech.", Marina di Ravenna, Italy Jun. 3–4, 1993.

"Thixocasting Casting of Magnesium Using a Conventional Casting Machine" Haavard Gjestland (Norsk Hydro a.s.): D0 2 44B SAE Tech Paper Ser (Soc Automot Eng) (USA) [SAE-930753] 7P (1993) pp. 101–106.

*"Rheocasting",* M.C. Flemmings, R.G. Riek and K.P. Young, Massachusetts Institute of Technology, Materials Science and Engineering, 25 (1976), pp. 103–117.

*"Die Casting Partially Solidified High Copper Content Alloys",* E.F. Fascetta, R.G. Riek, R. Mehrabian, M.C. Flemings, Massachusetts Institute of Technology, AFS Transactions, (1972), pp. 98–100.

*"Rheocasting Processes",* M.C. Flemings, R.G. Riek an K.P. Young, Massachusetts Institute of Technology, AFS International Cast Metals Journal, (Sep. 1976), pp. 11–22.

*"Semisolid Metal Casting and Forging",* Malachi P. Kenney, James A. Courtois, Robert D. Evans, Gilbert M. Farrior, Curtis P. Kyanka and Alan A. Koch, Metals Handbook, vol. 15, 9th Ed., (1988), pp. 327–338.

METHOD FOR HEATING METALLIC BODY TO SEMISOLID STATE

This application is a continuation of application No. 08/547,786, filed Oct. 25, 1995 and now abandoned.

FIELD OF THE INVENTION

The present invention relates to a method and apparatus for heating a metallic body, and more particularly to heating such body up to a predetermined temperature between the solidus and the liquidus.

BACKGROUND OF THE INVENTION

The technique of using semi-solid metals (SSM) was developed over twenty years ago. One major problem of such use is the existence of dendritic structures in the metal. To address this problem, British Patent No. 1,499,934 discloses heating a metal alloy up to a predetermined temperature between the solidus and the liquidus and maintaining this temperature until the dendrites at least begin to develop into a globular form. In practice, this meant a time of one or two hours. U.S. Pat. No. 5,009,844 discloses heating a hypoeutectic aluminum alloy having 5–12 wt % silicon at a rate not greater than 30° C. per minute and preferably not greater than 20° C. per minute to inhibit formation of free silicon particles. Such slow heating takes a rather long time when considering the temperatures necessary to reach the above-mentioned predetermined temperature.

The temperature ranges for thixotropic metals are relatively narrow and a long heating time was heretofore considered necessary to ensure an optimal temperature distribution over the whole cross-section. This was not easy, because various factors, such as low outer temperatures after heating, large cross-sections and the like, can impede a uniform temperature profile over the cross-section. The long heating times considered necessary to inhibit the occurrence of a temperature gradient over the cross-section prevented a practical use of this technique for industrial shaping processes.

U.S. Pat. No. 4,687,042 teaches away from melting dendrites which mainly form as a shell on the metallic body, i.e., on its periphery, and instead seeks to retain the dendritic shell and to strip it off like the hull of a potato. However, while the '042 patent only provides an example of vertical forging, it has been found, according to an article by Fascetta et al. in APS Transactions, 1974, pp. 95–100, that the quality at least of die casting parts where a cast material is heated to the semi-solid state and the dendrites are retained in the shot sleeve, while only the interdendritic melt enters the cavity, is rather poor. Certainly, one could use larger slugs of raw material, but this would also increase the amount of scrap metal which is considerable in this method. Such scrap metal cannot simply be thrown into a melting furnace and recast, but rather, the scrap has to be reprocessed under stirring by the manufacturer of the SSM raw material. Therefore, this method has not led to a major introduction of semi-solid materials into industrial processes.

Further prior art will be found in U.S. Pat. No. 3,663,730 or EP-A-0 147 243 where inductive heating of a metallic body is disclosed generally supplying a uniform amount of energy over time. Other documents disclosing the use of thixotropic metals are U.S. Pat. Nos. 3,954,455 and 4,434,839. It has also been suggested to shape such metals by die casting, as in an article by Flemings et al. in AFS International Cast Metals Journal, September 1976, pp. 11–22.

SUMMARY OF THE INVENTION

It is an object of the present invention to provide a method using short heating times so as to render the technique of semi-solid metals useful for industrial shaping processes.

It is another object of the present invention to provide a method by which better control for maintaining of the necessary narrow range of temperatures is achieved.

A farther object of the present invention is to provide a shaping apparatus, and more particularly a die casting machine which forms a tool for carrying out the methods outlined above.

BRIEF DESCRIPTION OF THE DRAWINGS

Further details will become apparent from the following description of non-limiting embodiments of the present invention given by way of example in the accompanying drawings in which.

DETAILED DESCRIPTION OF THE INVENTION

Figure 1:
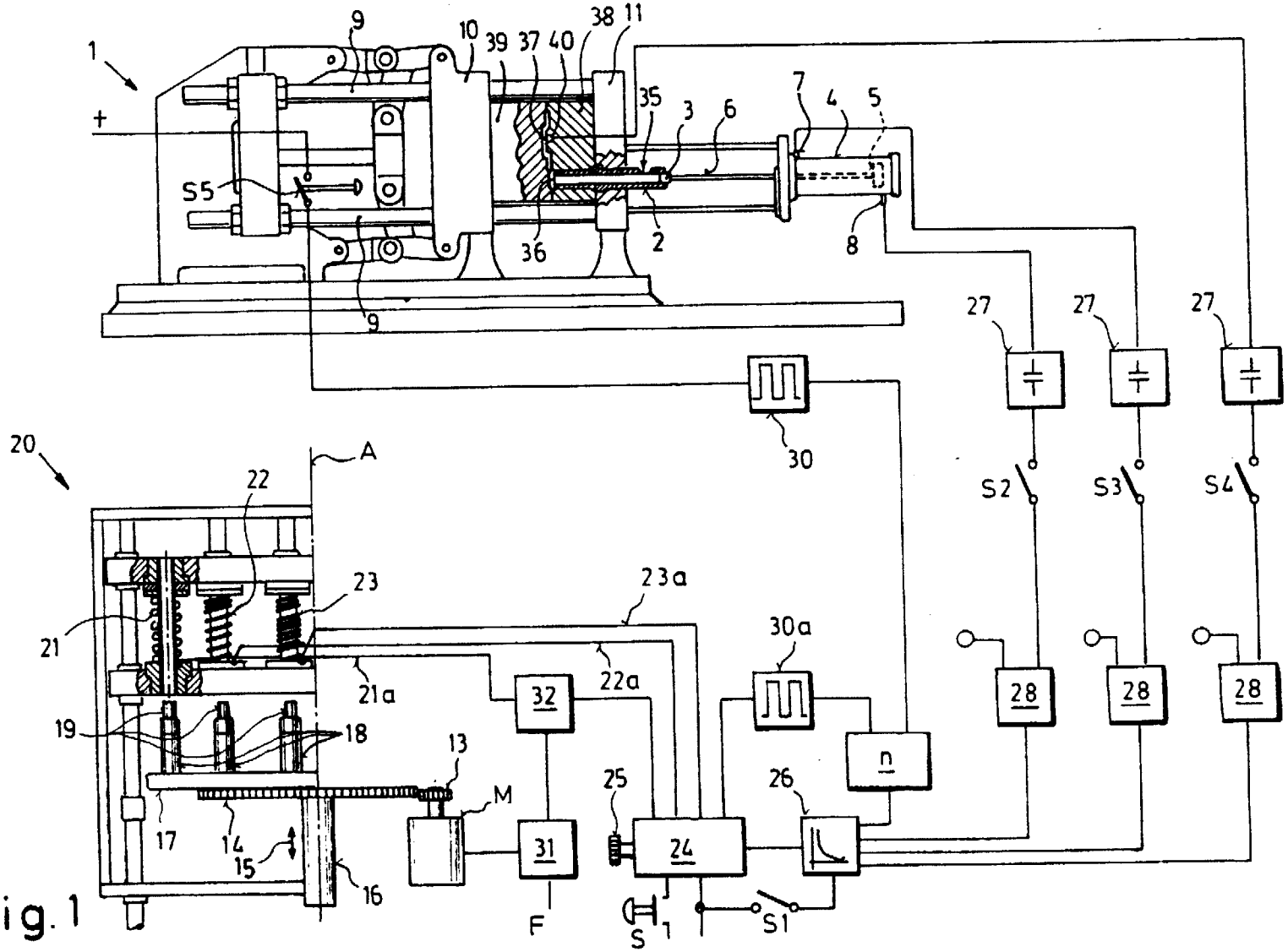
FIG. 1 shows a die casting machine together with a heating device for heating and partially melting metallic slugs into a semi-solid state.

In extensive investigations, the present inventors studied the behavior of crystallites of metals. In a first aspect of the invention, is that it has been found that, although the crystallites need enough time for forming or reorganizing, the time needed depends to a wide extent upon their environment. Most of the metals used are alloys consisting of different elements with different melting points. If part of the constituents of an alloy is already molten, the crystallites are more mobile. Thus, if the crystals could have a greater mobility during the heating step, the total heating time could be reduced.

According to this first aspect of the invention it is provided that the metallic body is initially heated with a higher amount of energy, whereafter the supply of energy is lowered. The higher amount of energy liquefies the constituents with a low melting point relatively quickly giving the crystallites a high mobility to reform into globulites, if necessary, so that they can move from the very beginning of the heating operation, and no time is lost. Moreover, distribution of heat occurs relatively slowly so that a uniform energy supply, as in the prior art, or an increasing energy supply would promote an unequal distribution of heat over the cross-section of the metallic body so that there will necessarily be some undesirable differences in its microcrystalline structure. However, the metallic body according to the present invention is initially heated with a higher amount of energy whereby the initially introduced amount of heat has enough time to distribute uniformly over the cross-section, while the metallic body is further heated with a reduced supply of energy. Furthermore, due to the first step of the invention, in which the slug is quickly heated up (in general, at a rate of ≧20° C./minute), the formation of large silicon crystals (as in the prior art) is avoided. Since such quick heating acts first on the periphery of a slug where dendrites have their preferred location, globulation is enhanced in this critical zone. Of course, practice of the invention is facilitated by the fact that nowadays raw materials have only small dendrites, or such raw materials can at least be selected.

The method of the invention is not restricted to the application of die casting. The present method is also applicable to other shaping processes, such as forging, where heating of a metallic body is necessary.

According to another aspect of the present invention, the supply of energy can be varied over time so as to better control the optimum thixotropic state of the metal body. This can be done in a shaping process especially with shaping under pressure, by: monitoring a parameter representative of the solid (or liquid) contents of the heated slug, particularly the gradient of pressure over time; and controlling the step of supplying energy to maintain the parameter constant, such as a predetermined gradient of pressure. It has been found that the parameters of pressure, and more particularly the pressure gradient over time, will vary as a coarse function of the solid contents and/or the temperature of the metallic body. Since, under normal conditions, the solid contents and the temperature will vary only to a small extent, the supply of energy will also be held substantially constant and will only vary when ambient conditions change. Other possible parameters include the temperature (e.g., measured by a pyrometer) or changes in an eddy current caused in the slug (e.g., measured using a magnetic reading).

A similar control for a shaping process can be accomplished by measuring the cycle period of a shaping machine with repeating operational cycles, and by controlling the supply of energy to maintain the cycle period substantially constant. This is because the cycle period depends upon cooling times which will be prolonged, if the supply of energy is excessive.

In FIG. 1, a die casting machine 1 is illustrated comprising a shot sleeve 2 to be filled with metal through a filling opening 35. Within the sleeve 2 a ram or shot plunger 3 is displaceable by means of a drive plunger 5 displaceable within a drive cylinder 4, the drive plunger being connected to the shot plunger 3 via a rod 6. A moveable die support 10 is displaceable by a known toggle drive, as shown (not referenced), along guide columns 9 towards a stationary die support 11 or away from it. Die parts or halves 38, 39 are secured to the die supports 10, 11 in a manner known per se and define a die cavity 37 between them communicating with the shot sleeve 2 via a gate and runner system 36.

All the parts of the die casting machine described up to now are conventional and can be formed in different arrangements apparent to those skilled in the art. It should also be noted that the present invention is not restricted to die casting machines, but can likewise be applied to other metal shaping machines, particularly to those where pressure is applied to the metal. Therefore, the machine 1 shown in FIG. 1 constitutes an example of a suitable shaping machine.

A heating device 20 is assigned to the shaping machine 1 which is, for example, a die casting machine, in order to heat metallic bodies 19. After reaching a thixotropic state, the bodies 19 are individually inserted into the filling opening 35 of the shot sleeve 2 at each respective machine cycle (which comprises opening and closing of the die parts 38, 39 and the shot of metal into the cavity 37 by the shot plunger 3) by inserting means known per se, such as by means of an inserting robot (not shown) or by an appropriate conveyor. The heating device 20 is, apart from the features according to the present invention to be described in the following, also conventional and, therefore, may be modified in its details in accordance with the needs of a particular heating application.

In the embodiment shown, the heating device 20 is adapted for upright freestanding metallic bodies 19 of substantially cylindrical shape, each of which stands on a platform or landing 18 on a turntable 17 (shown only up to its rotational axis A). The turntable 17 comprises a shaft 16 which is displaceable up and down (see arrow 15) and can be driven by a gear wheel 14 wedged on shaft 16. For driving, there is an electric motor M, having a pinion 13 engaging the gear wheel 14. Of course, when displacing the turntable 17 and the gear wheel 14 up and down, the motor M is also displaced with them. Alternately, shaft 16 can be a stationary hollow shaft in which an inner shaft is displaceable together with the turntable 17 while being connected to the outer shaft 16 via mutual longitudinal grooves and protrusions. In another modification, induction coils 21–23 can be moved relative to stationary slugs 19.

In this manner, the turntable can carry out not only a movement up and down, which is controlled by a fluidic (e.g., a hydraulic) unit (not shown) at the lower end of the shaft 16, but also a stepwise rotational movement which is carried out and is coordinated with the vertical movement in a manner known per se such that the metallic bodies 19 first enter the interior of a first induction coil 21 from below, are pulled out after initial heating by lowering the turntable 17, and then the turntable 17 is indexed (rotated by one step) so that the metallic body arrives at a position just below the next induction coil 22 where it is further heated after raising the turntable 17, after which the procedure is repeated moving the metallic body to the next coil 23. The number of induction coils necessary depends on the required period of heating and/or on the size of the metallic body 19, on the product to be manufactured and on the type of shaping machine 1 and the cycle period. At the end of the heating procedure, the metallic body 19 is heated sufficiently for shaping and is taken from its platform 18 and supplied to the machine 1 and its filling opening 35. The parts of the heating device described so far are conventional.

According to the present invention, programmed and controlled heating of the metallic bodies 19 is effected to which end at least one of the following measures is provided. It will be understood from the following description that the turntable 17 is not indispensable, but that the metallic bodies could be heated by other heating apparatus such as a linear heating arrangement wherein the metallic bodies are displaced linearly between or through heating coils. If desired, a single coil 21, 22 or 23 could be sufficient, the greater number being mainly chosen for shortening the heating cycle period or to adapt it to the cycle period of the machine 1.

From FIG. 1 it can be seen that according to a an exemplary embodiment of the invention, the inductive coils 21–23 are not uniformly constructed. Instead, the coils have different numbers of windings. It is clearly shown in a cross-section of the coil 21 that it has about 6 windings whereas the subsequent coil 22 has about 8 windings, and the third coil 23 has still more. In this manner the energy supplied to the metallic body during heating is reduced with every step, coil by coil, the above numbers of windings or their relationship being one example of how the differential heating according to the invention can be accomplished. In fact, the amount and the consumption of energy supplied to the metallic bodies 19 will depend upon several factors which are discussed below. Nevertheless, it has been found that the initial temperature to which the metallic bodies 19 are heated is chosen to transform any dendritic phase into a globular form. To accomplish this result, the initial temperature is at least 50%, preferably at least 60% of the temperature necessary to melt any dendrites that might be present in the metallic body. This need not necessarily be done in a single heating coil 21, but depending on the cycle period of the machine and the size of the metallic body and all the other factors discussed above, more than one coil 21–23 can be used to perform this initial heating step. With such a temperature, the conditions and the environment will be provided to the crystallites to enable their relatively fast movement into the desired globular shape, and further heating afterwards serves mainly the purpose of distributing the heat evenly over the cross-section and providing the time for rearrangement of the crystallites.

This method results in a considerable reduction of heating time when considering that this initial heating step is, for example, effected within 120 seconds in maximum, more preferably within 90 seconds as compared to the hours needed heretofore.

Especially if metallic bodies (or slugs) 19 of varying volumes have to be cast, the calories supplied can be used as a base for determination of the initial energy to be supplied. In this case and for the conventional Al-Si alloy family as represented by alloy A356, more than 100 calories per gram of the metallic body 19 should be used in the first or initial heating step. However, since the range of temperatures where a semi-solid state of the metallic bodies 19 will develop is rather narrow, it is preferred that not more than 200 calories per gram of the metallic body can be supplied in the first step. In practice, an amount of about 130 calories±10% per gram of each metallic body has been found advantageous.

In the second heating step (and some further heating steps) the energy can either be lowered approximately in accordance with an e-function, as would correspond to theory (e.g., 30 to 80 or 50 to 60 calories per gram of the metallic body). However, since this could result in additional expenses on the construction side and the e-function is an asymptotic function, it has turned out to be simpler when using a linear function, i.e., maintaining the supply of energy substantially constant.

From the above, it will be clear that if a single coil 21 were to be used, a programmed supply of energy should be provided in order to heat the metallic bodies initially with a higher amount of energy, whereafter the supply of energy is lowered. Also in this respect, stepwise lowering of energy is easier to accomplish, since it is sufficient to use coils with different numbers of windings, as discussed above.

Turning back to FIG. 1, each one of the coils 21–23 is connected to a power supply unit 24. To this end, while a single line 21*a*, 22*a*, 23*a*, is shown between unit 24 and each coil, it will be understood that pairs of electric lines supply the coils with power. The unit 24 may be connected to the electric circuit by means of a main switch S. The amount or basic level of energy supplied to the coils 21–23 may be adjusted by any appropriate adjusting device 25 (e.g., as a rotary knob as shown in FIG. 1). As mentioned above, a program unit 26 may be provided for controlling the amount of energy supplied to the coils 21–23 (and, thus to the metallic bodies 19) over time in accordance with a desired program and function. As indicated at 26, the unit may have memorized a program, by which the energy supplied to the coils 21–23 or only to one of them can describe the course of a predetermined curve, and preferably of a constant or even a decreasing curve in the second step of the method according to the invention. For example, in the stepwise heating of the metallic slugs or bodies 19, different non-linear curves could be used in order to result in an approximate e-function in total (e.g., approximated by an exponential curve or a quadratic curve).

It will be recognized that program unit 26 allows a single coil 21 to be used for the entire heating cycle, and its energy supply could be controlled by this unit, although stepwise heating is preferred as mentioned above. When approximating an e-function, similar circuits could be applied as used for slowly starting electro-locomotives. However, in a machine shaping under pressure, such as the die casting machine 1 of FIG. 1, there are still other approaches which may be applied either individually or in combination. Thus, in addition to the known possibilities of determining the solids contents of a slug by monitoring its temperature, changes of eddy currents caused in it or other parameter, we have observed that the state of the heated metallic body 19 appears clearly in energy consumption of the drive cylinder unit 4, 5. The pressure, also rising when using liquid metal, changes its angle of climb, i.e., the pressure gradient, so that the pressure levels over time can be considerably changed. This change of the angle of climb is a function of the state of the metal (solid contents) and its temperature. Without wishing to be bound to any theory, this function results obviously from the fact that the solid contents in the thixotropic metal appears to vary quite quickly when altering the temperature within the narrow range (close to the so-called "solid phase line temperature"), thus, resulting in significant changes in pressure necessary to carry out the thixoforming operation.

Therefore, one possibility of optimizing the temperature is that this pressure climb or its angle, i.e., the change in pressure over time, is measured, and heating of the slugs is controlled accordingly. Which type of pressure measurement in a die casting machine is used, may be decided in each particular case, because, although it is known that there is a correlation between the pressure at the drive plunger 5 and the pressure at the shot plunger 3, on the one hand, and between the latter and the pressure in the cavity 37 or in the gate and runner system 36, on the other hand, there are yet some differences.

In the embodiment shown in FIG. 1, there are three pressure sensors 7, 8 and 40, sensors 7, 8 being arranged at the front side and the back side of the drive plunger 5, respectively, and sensor 40 being located in the die cavity 37. In the sense of the above discussion, however, any other type of arrangement, such as in the gate and runner system 36 or directly on the plunger 3, or a combination of signals either weighted or not, may be employed.

Each of the pressure sensors 7, 8, 40 used to this end has its output connected to an assigned differentiating stage 27 in order to obtain a value representative for the actual rise of pressure over time, i.e., the pressure gradient. This differentiating stage 27 comprises suitably not only the differentiating capacitor, as indicated, but, if convenient, also a signal shaping stage converting the differential signal obtained into another signal, preferably into a square-wave signal of corresponding size and/or duration (most preferably of a predetermined size or amplitude, but with a duration varying in accordance with the rise of pressure). Depending on the construction of the circuit, the differential signal can also be converted into a signal of a frequency corresponding to the rise of pressure (e.g., by means of a frequency generator whose frequency is controlled by the differential signal).

Within the circuitry, there is suitably at least one switch S2, S3 or S4 so that the circuit may be operated with the one or the other pressure sensor or with a combination of them. Evaluation of the pressure rise signal obtained from stage 27 may then be effected in a stage 28. Depending upon the type of the pressure rise signal emerging from stage 27, the stage 28 will be constructed accordingly. If the size (i.e., the amplitude) of the signal corresponds to the pressure gradient, it may either be directly compared with a preadjusted threshold value of the stage 28, i.e., the stage may be constructed as a threshold switch, the pressure rise signal from stage 27 falling below this threshold meaning that the pressure applied in the die casting machine is within the admissible processing range, whereas exceeding the threshold value of the stage 28 results in an output signal of this stage to increase the amount of energy set by the program unit 26 by a predetermined value, e.g., by a predetermined step (i.e., heat energy is increased by a predetermined amount). In this way, the program unit 26 may operate without using any predetermined function, such as the e-function mentioned above, and may adjust the heat energy supplied only as a function of the pressure rise signal from stage 27 or any other pressure parameter signal obtained, such as the absolute pressure at least one predetermined moment of pressure rise. Thus, the stage 28 may be formed as a control stage.

Another factor to be taken into account with shaping machines, particularly with die casting machines, is the cycle period. Since maintaining a relatively narrow temperature range plays an important role in obtaining a satisfactory quality of the finally shaped metallic bodies, it is essential that the cycle times of the machine 1 match with those of the heating device 20 in order to prevent variations of temperature (and, thus of the solid contents) of the metallic bodies 19 supplied to the machine 1.

In accordance with the present invention, matching is done in a shaping machine, such as in a die casting machine 1, in that the cycle period of the machine is determined, if it is not already given and can be considered as a fixed value. For determining the cycle period, a switch S5 may be provided which is actuated by the moving die support 10 at the beginning and the end of a cycle, i.e., the switch is switched on at the beginning and is switched off at the end when the support 10 moves (with reference to FIG. 1) to the left.

Actuation of the switch S5 triggers a start-stop-oscillator 30 acting here as a timer. It will be understood that a gate circuit may also be opened by switch S5 in order to allow passage of clock signals from a continuously running clock generator. Alternatively, other timers could also be used, such as a bi-stable trigger circuit (flip-flop) which is actuated by switch S5 or a capacitor of an RC-circuit which changes its charge when the switch S5 is actuated. Likewise, it will be understood that the operation of the switch S5 may also be inverted, if desired, by opening it upon movement of the support 10 to the right. In this case either an inverter is provided at the output or a timer is used having automatically an inverse behavior (e.g., the time of discharge of a time determining capacitor is measured rather than its charging time).

In the case where the cycle period of the heating device 20 is constant, it would be sufficient (similarly as in the case with the stage 28) to compare it with a fixed value (a threshold value). It is, however, preferred to provide a clock generator 30*a* for the heating device 20, e.g., controlled by the power supply unit 24, optionally by a control stage 31 for the motor M (or another timer), and to compare both cycle periods, i.e., that of the machine 1 and of the heating device 20, within a comparator "n." In the case of the clock generators 30 and 30*a*, this may simply be a counter "n" which counts up and down and which uses the signal of the clock generator 30 for counting up while using the signal of the clock generator 30*a* for counting down. In this way, the output of the counter "n" will be zero, if the cycle periods match with each other. Only in case of a deviation in one or the other sense, a positive or negative output signal of the counter "n" will be obtained which then is supplied to the stage 26 for heating the metallic bodies 19 quickly or slowly.

Either this signal is also supplied to the devices which determine the cycle time of the heating device 20, such as to the control stage 31 for the motor M and to the drive unit (not shown) for raising and lowering the turntable 17, respectively, in order to attain a coincidence of the cycle periods, or this is done by a more accurate procedure which is more preferred according to the invention.

It has been found that the power consumption of the coils 21–23 is not constant over time. More specifically, there is a jump in current consumption when a certain state is reached during heating the metallic body 19 up to a temperature between solidus and liquidus. It is an important aspect of the present invention to employ this phenomenon, for which we have not yet found the reason, for controlling purposes wherein this control could also be applied independently from any control of heating, i.e., this aspect is of particular and independent importance.

Thus, a measuring circuit 32 may be connected to at least one coil, in the present case, as is preferred, to the first coil 21, in order to monitor the energy consumption of this coil. It will be understood that such measuring circuits are always connected to both electric lines of a load, as it has already been noted that the single line shown actually includes two electric lines. This arrangement 32 is suitably constructed as a current measuring circuit, although voltage could likewise be measured or both, if desired, and upon occurrence of the jump in current consumption, it supplies an appropriate output signal to the control circuit 31 which has also an output F for the fluidic drive unit for raising and lowering the turntable 17.

The circuit 31 is preferably designed such that upon occurrence of the jump signal mentioned above, it reduces the cycle time by such an amount that it is able to operate with the newly adjusted cycle time without again receiving a jump signal. Optionally, the stage 32 may also be connected to the program unit 26 and, upon occurrence of the jump signal, may trigger a reduction (e.g., slight reduction) of heating energy.

Figure 2:
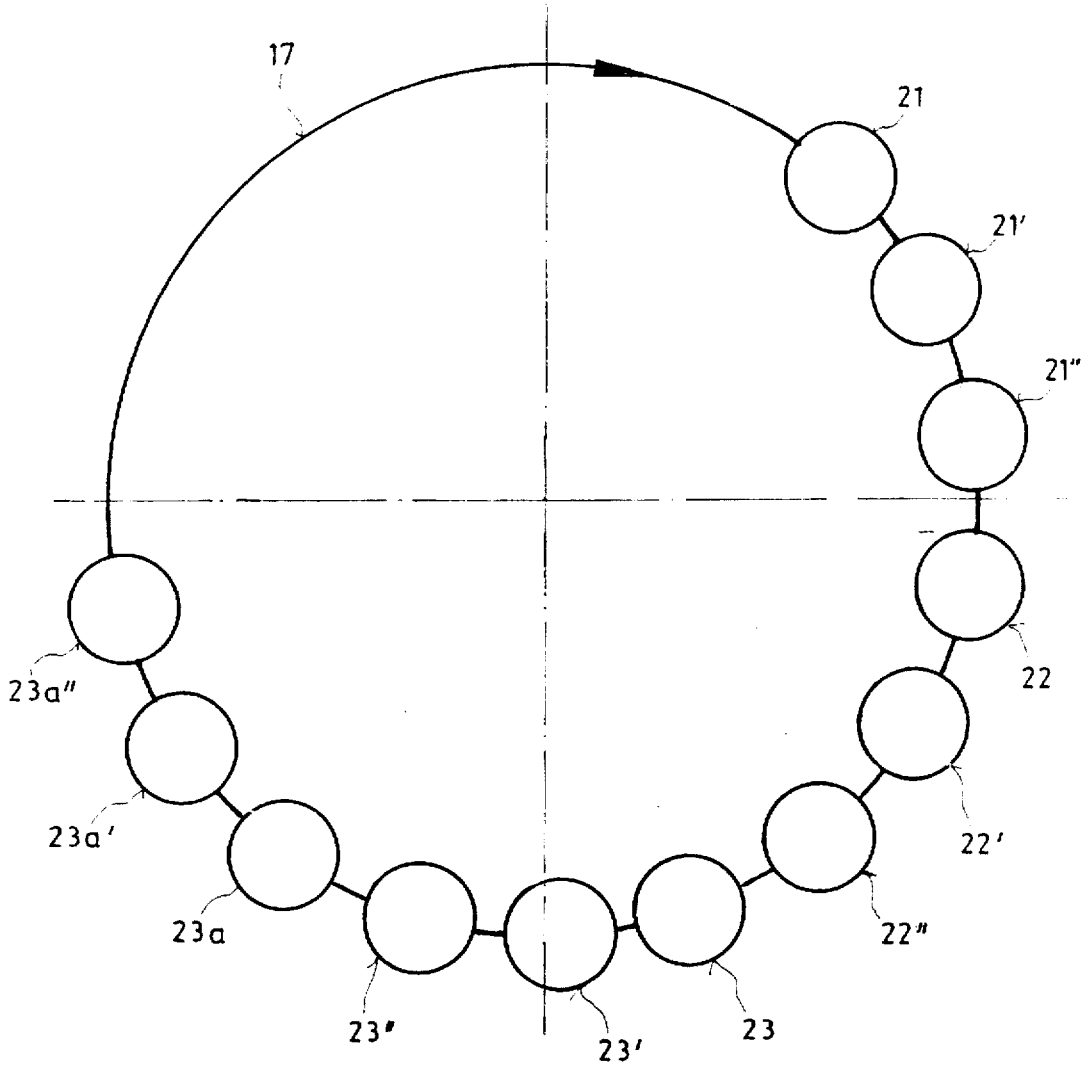
FIG. 2 schematically illustrates the heating device in a plan view.

While FIG. 1 gives a general view of the arrangement according to the invention, FIG. 2 shows a practical example of a turntable 17 in a more diagrammatic way. As shown, there is a first group of three coils 21, 21', 21" for accomplishing initial heating up. These three coils 21, 21', 21" supply at least 50%, or preferably at least 60%, of the total heating energy needed to bring the metallic bodies 19 (see FIG. 1) up to a temperature which lies in the range between the solidus and the liquidus. Thus, when using an aluminum alloy, e.g., an aluminum-silicon alloy, the temperature after the last coil 21" of this first group can be as high as 90% of the desired end temperature which is, for example, 590° C., and the heat content may be as high as 66% of the desired end heat content. In the case of a copper alloy, of course, the end temperature will be correspondingly higher and will amount, for example, to 930° C. When using more than one coil for one heating step, a finer graduation of the heating temperatures can be achieved, for example by lowering the energy supplied from coil to coil, e.g., from 80 kW down to 50 kW. In the arrangement shown in FIG. 2, however, the three coils 21, 21', 21" can each be supplied with 70 kW, 50 Hz so that the temperature of slug 19 at the end of this first group is about 520° C.

In the next group, there are also three coils 22, 22', 22", which are supplied with an MF-current of 700 Hz. This group can add about 11% of the total heat energy. It has been found that in order to maintain the desired slug temperature, coil 22" can be switched off and the heating performed with only coils 22 and 22'.

With the above described arrangement, it is possible to maintain the slug temperature linear in the groups of coils 23, 23', 23" and 23*a*, 23*a'*, 23*a"* so that each group adds about 11% of the total heat energy. Also, these groups can be fed with an MF-current of 700 Hz. The turntable 17 rotates and moves up and down, as discussed above, with slightly varying times per step between a little bit less than 10 seconds per coil or 29.7 seconds per group up to about 13 seconds per coil or 39.3 seconds per group. In any case, the total cycle period of the turntable 17 for heating up the metallic slugs 19 in the first step (group 21, 21', 21") can remain within a range of 120 seconds in maximum or even 90 seconds in maximum. It has been observed that heat energy is transferred more deeply into the radius of the slugs with a lower frequency so that the first group of coils 21, 21', 21" heats more effectively, while the higher frequencies heat more at the surface so that the distribution of energy throughout the diameter of the slugs is effected by heat conduction rather than by direct heating.

With reference to the weight of the slugs, the heat energy supplied was determined to be exactly 120 calories per gram in the first group of coils 21, 21', and 21" whereas it was 60 calories per gram in the second group of coils 22, 22', 22" before switching off coil 22" and 50 calories per gram afterwards. In the last groups of coils 23, 23', 23" and 23*a*, 23*a'*, 23*a"*, however, an energy supply of about 55 calories per gram was maintained.

While the foregoing example used 12 coils in total, it has been found that a better adjustment and shorter cycle times can be achieved by increasing the number of coils, e.g., 16 coils. Of course, the number of coils cannot be increased at will since the cycle period of the machine 1 also has to be considered and, moreover, a higher number of coils involves higher constructional expenses.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method for heating a metallic body by at least one heat source up to a predetermined temperature between the solidus and the liquidus, said method comprising heating said metallic body while supplying different amounts of energy over time such that dendrites in an outer peripheral region of the metallic body are transformed into globular form, said metallic body being initially heated with a higher amount of energy, whereafter the amount of energy is lowered, the higher amount of energy transforming dendrites in an outer peripheral region of the metallic body into globular form.

2. The method as claimed in claim 1, wherein said metallic body includes a dendritic shell, the higher amount of energy transforming dendrites in the dendritic shell into globular form.

3. The method as claimed in claim 1, wherein heating is effected in at least two steps, in at least one first step the metallic body is heated with a higher energy supply, in at least one second step said metallic body is heated with a lower energy supply.

4. The method as claimed in claim 3, wherein heating with a lower energy supply is effected in at least two steps.

5. The method as claimed in claim 3, further comprising using separate heat sources for at least a number of said steps, and conveying said metallic body from one heat source to the next heat source.

6. The method as claimed in claim 1, wherein supplying different amounts of energy follows at least approximately an exponential-function.

7. The method as claimed in claim 1, wherein supplying different amounts of energy follows at least approximately a linear function.

8. The method as claimed in claim 1, wherein said heat source is an inductive heat source, the method further comprising monitoring energy consumption of said heat source and lowering the supply of energy when a predetermined change in energy consumption occurs.

9. The method as claimed in claim 1, further comprising the steps of shaping said metal body under pressure after reaching said temperature between solidus and liquidus, and monitoring a pressure parameter over time, and controlling said step of supplying energy to a subsequently heated metallic body to maintain a predetermined pressure parameter.

10. The method as claimed in claim 9, wherein said pressure parameter is the pressure gradient.

11. The method as claimed in claim 1, further comprising the steps of shaping said metal body in a forming machine after reaching said temperature between solidus and liquidus, said forming machine being operated in cycles of a certain cycle period, measuring said cycle period, and controlling said step of supplying energy to maintain said cycle period substantially constant.

12. The method as claimed in claim 1, further comprising the steps of shaping said metal body under pressure after reaching said temperature between solidus and liquidus, monitoring a process parameter over time, and controlling said step of supplying energy in response to variations in the process parameter.

13. A method for heating a metallic body by at least one heat source up to a predetermined temperature between the solidus and the liquidus, said method comprising heating said metallic body while supplying different amounts of energy over time such that dendrites in an outer peripheral region of the metallic body are transformed in globular form, said metallic body being initially heated during a first step with a higher amount of energy, whereafter the amount of energy is lowered during a second step, said predetermined temperature being chosen to transform any dendritic phase within said metallic body into a globular form, in said first step the metallic body being heated to at least 50% of said predetermined temperature.

14. The method as claimed in claim 13, wherein in said first step the metallic body is heated to at least 60% of said predetermined temperature.

15. The method as claimed in claim 13, wherein said first step is effected within 120 seconds.

16. The method as claimed in claim 15, wherein said first step is effected within 90 seconds.

17. The method as claimed in claim 15, wherein said first step is effected in at least two sub-steps.

18. A method for heating a metallic body by at least one heat source up to a predetermined temperature between the solidus and the liquidus, said method comprising heating said metallic body while supplying different amounts of energy over time such that dendrites in an outer peripheral region to the metallic body are transformed in globular form, said metallic body being initially heated in a first step with a higher amount of energy, whereafter the amount of energy is lowered in a second step, said predetermined temperature being chosen to transform any dendritic phase within said metallic body into a globular form, in said first step the metallic body being heated by supplying more than 100 calories per gram of said metallic body.

19. The method as claimed in claim 18, comprising heating said metallic body in said first step by supplying not more than 200 calories per gram of said metallic body.

20. The method as claimed in claim 18, comprising heating said metallic body in said first step by supplying about 130 calories±10% per gram of said metallic body.

21. The method as claimed in claim 18, comprising heating said metallic body in said second step by supplying no more than half the calories of said first step.

22. The method as claimed in claim 21, comprising heating said metallic body in said second step by supplying about 30 to 80 calories per gram of said metallic body.

23. The method as claimed in claim 22, comprising heating said metallic body in said second step by supplying about 50 to 60 calories per gram of said metallic body.

* * * * *